US009140491B2

(12) United States Patent
Davidian

(10) Patent No.: US 9,140,491 B2
(45) Date of Patent: Sep. 22, 2015

(54) METHOD AND APPLIANCE FOR SEPARATING AIR BY CRYOGENIC DISTILLATION

(75) Inventor: Benoit Davidian, Saint Maur des Fosses (FR)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 561 days.

(21) Appl. No.: 13/576,230

(22) PCT Filed: Feb. 3, 2011

(86) PCT No.: PCT/FR2011/050212

§ 371 (c)(1),
(2), (4) Date: Jul. 31, 2012

(87) PCT Pub. No.: WO2011/095739

PCT Pub. Date: Aug. 11, 2011

(65) Prior Publication Data

US 2012/0297823 A1 Nov. 29, 2012

(30) Foreign Application Priority Data

Feb. 4, 2010 (FR) ..... 10 50775

(51) Int. Cl.
*F25J 3/00* (2006.01)
*F25J 3/04* (2006.01)

(52) U.S. Cl.
CPC ..... *F25J 3/04418* (2013.01); *F25J 3/0406* (2013.01); *F25J 3/0409* (2013.01); *F25J 3/0486* (2013.01); *F25J 3/04206* (2013.01); *F25J 3/04309* (2013.01);
(Continued)

(58) Field of Classification Search
CPC ..... F25J 3/0406; F25J 3/0409; F25J 3/04206; F25J 3/04309; F25J 3/04351; F25J 3/0486; F25J 3/04418; F25J 3/04412; F25J 2250/04; F25J 2250/40; F25J 2250/50; F25J 2245/42; F25J 2200/06; F25J 2200/40; F25J 2200/04; F25J 2200/08; F25J 3/04157; F25J 3/04448; F25J 3/04472; F25J 2210/40; F25J 2230/42; F25J 2230/50; F25J 2200/50; F25J 2200/54; F25J 2230/08; F25J 2215/40
USPC ..... 62/643, 648
See application file for complete search history.

(56) References Cited

U.S. PATENT DOCUMENTS 4,526,595 A * 7/1985 McNeil ..... 62/651
5,341,646 A * 8/1994 Agrawal et al. ..... 62/646
(Continued)

FOREIGN PATENT DOCUMENTS

FR 2930329 10/2009
FR 2930331 10/2009

OTHER PUBLICATIONS

International Search Report for PCT/FR2011/050212, Jun. 22, 2011, 2 pages.
PCT/FR2011/050212, Written Opinion of the International Searching Authority (6 pages).

*Primary Examiner* — Frantz Jules
*Assistant Examiner* — Keith Raymond
(74) *Attorney, Agent, or Firm* — Justin K. Murray

(57) ABSTRACT

In a method for separating air in a column system, by cryogenic distillation, compressed, purified and cooled air is separated in the column system in order to form an oxygen-enriched flow and a nitrogen-enriched flow. At least one column of the column system contains a vaporizer-condenser for ensuring the vaporization of a liquid enriched in oxygen in relation to the air by means of heat exchange with a calorigenic fluid, the calorigenic fluid having been compressed upstream of the vaporizer-condenser in a compressor having a cryogenic inlet temperature, the calorigenic fluid being at least partially condensed in the vaporizer-condenser, and a cryogenic liquid is added to the calorigenic fluid upstream of the vaporizer-condenser.

13 Claims, 1 Drawing Sheet

(52) U.S. Cl.
CPC ..... *F25J 3/04351* (2013.01); *F25J 3/04412* (2013.01); *F25J 2200/06* (2013.01); *F25J 2200/40* (2013.01); *F25J 2200/54* (2013.01); *F25J 2245/42* (2013.01); *F25J 2250/04* (2013.01); *F25J 2250/40* (2013.01); *F25J 2250/50* (2013.01)

(56) References Cited

U.S. PATENT DOCUMENTS

2004/0055331 A1* 3/2004 Corduan et al. ..... 62/643
2007/0251267 A1* 11/2007 Ha et al. ..... 62/615

* cited by examiner

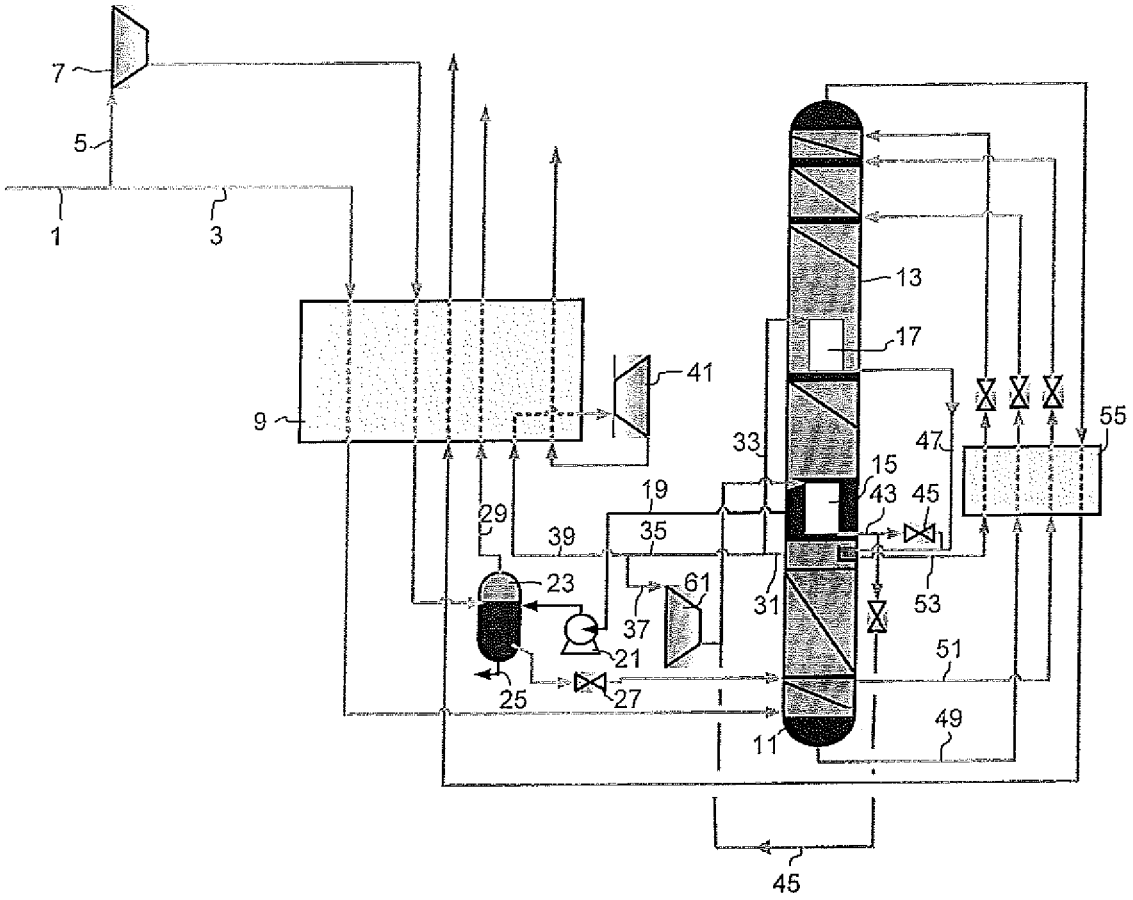
7
5
1
3
9
41
13
17
33
15
43
45
47
55
19
29
39
35
23
61
37
21
31
53
51
25
27
11
49
45

METHOD AND APPLIANCE FOR SEPARATING AIR BY CRYOGENIC DISTILLATION

CROSS-REFERENCE TO RELATED APPLICATIONS

This application is a §371 of International PCT Application PCT/FR2011/050212, filed Feb. 3, 2011, which claims §119 (*a*) foreign priority to French patent application 1050775, filed Feb. 4, 2010.

BACKGROUND

The present invention relates to processes and devices for the separation of air by cryogenic distillation. It is known to distill air in a double column comprising a medium-pressure column connected thermally to a low-pressure column which surmounts it.

The thermal connection between the two columns can be obtained by using two evaporators placed one above the other in the low-pressure column. The lower evaporator can be heated by means of a nitrogen flow withdrawn from the medium-pressure column and then compressed in a cold compressor, and the upper evaporator can be heated by a flow of medium-pressure nitrogen taken from the medium-pressure column without having been compressed upstream of the evaporator.

A cold compressor is a compressor having a cryogenic inlet temperature, a cryogenic temperature being less than −50° C.

The nitrogen compressed in the cold compressor has to be condensed in the lower evaporator of the low-pressure column. The fluid compressed under cold conditions thus arrives relatively warm in the evaporator, with a high ΔT, before beginning to condense: this means that even if the evaporator has a low temperature pinch, the ΔT at the hot end is relatively high.

If the evaporator/condenser malfunctions, in particular if a partial blockage or poor distribution occurs, there is a high risk of evaporation to dryness locally, which is harmful to the safety of the device due to the presence of impurities of $C_nH_m$ type with an oxygen-rich fluid. This is all the more appreciable on a falling-film evaporator/condenser.

FR-A-2 930 329 describes a process according to the preamble to claim 1.

SUMMARY OF THE INVENTION

One of the aims of the invention is to overcome malfunctions of the evaporator/condenser.

According to the invention, a calorigenic fluid, for example medium-pressure nitrogen, is cooled at the outlet of a cold compressor, by injecting a portion of the condensed fluid into the evaporator/condenser at the inlet of the evaporator/condenser, in order to bring it to its dew point, before being condensed. This makes it possible to nullify the overheating of the fluid and makes possible a use which is easier in terms of safety for the evaporator, in particular a falling-film evaporator. This takes place without a significant energy penalty.

Injection of other cryogenic fluids can replace this condensed fluid.

According to a subject matter of the invention, provision is made for a process for the separation of air in a system of columns by cryogenic distillation in which compressed air, purified and cooled, is separated in the system of columns in order to form an oxygen-enriched flow and a nitrogen-enriched flow, in which at least one column of the system of columns comprises an evaporator/condenser which has to ensure the evaporation of a liquid enriched in oxygen with respect to the air by means of an exchange of heat with a calorigenic fluid, the calorigenic fluid having been compressed upstream of the evaporator/condenser in a compressor having a cryogenic inlet temperature, the calorigenic fluid being at least partially condensed in the evaporator/condenser, characterized in that a cryogenic liquid is added to the calorigenic fluid upstream of the evaporator/condenser.

According to other optional characteristics:

- the cryogenic liquid is composed of a portion of the calorigenic fluid after it has been condensed in the evaporator/condenser;
- the system of columns is a double or triple column, the calorigenic fluid is a nitrogen-enriched flow withdrawn from one of the columns operating at higher pressure and the reboiler is in another of the columns operating at lower pressure;
- the evaporator/condenser is a falling-film evaporator;
- the cryogenic liquid is pressurized either by hydrostatic pressure or by a pump;
- the cryogenic liquid comprises at least 75 mol % of nitrogen, indeed even at least 90 mol % of nitrogen;
- the cryogenic liquid is added to the calorigenic fluid downstream of the compressor.

According to another subject matter of the invention, provision is made for a device for the separation of air in a system of columns by cryogenic distillation, comprising:

a) a system of columns
b) an evaporator/condenser capable of evaporating a liquid enriched in oxygen with respect to the air
c) an air compressor
d) a pipe connecting the air compressor to the system of columns
e) a cryogenic compressor of calorigenic fluid connected to an inlet of the evaporator/condenser
f) at least one pipe for condensed fluid connecting an outlet of the evaporator/condenser to at least one column of the system of columns, characterized in that it comprises a pipe, and optionally a pump, connecting the outlet of the evaporator/condenser and/or a storage tank for cryogenic liquid to the outlet of the cryogenic compressor without passing through the evaporator/condenser.

The device can comprise the following characteristics:

- the system of columns is a double or triple column, one of the columns operating at lower pressure comprising the evaporator/condenser as vessel evaporator;
- the cryogenic compressor is connected to the top of one of the columns operating at higher pressure;
- means for pressurizing a cryogenic liquid which are suitable for pressurizing a liquid circulating in the pipe connecting the outlet of the evaporator/condenser to the outlet of the cryogenic compressor.

The invention also comprises an oxy-combustion plant comprising an air separation device as described above and a boiler fed with the oxygen produced by the air separation device.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

FIG. 1 represents a process in accordance with an embodiment of the present invention.

DETAILED DESCRIPTION OF THE INVENTION

The invention will be described in more detail with reference to the FIGURE, which shows a process according to the invention.

A flow of air 1 is compressed in a compressor (not illustrated) up to 4 bar and then divided into two; a portion 3 of the air is cooled in an exchange line 9 and is sent to the medium-pressure column 11 of a double column. The double column comprises a medium-pressure column 11 and a low-pressure column 13 connected thermally to one another, the low-pressure column surmounting the medium-pressure column.

The remainder 5 of the air is boosted in a booster 7, cooled in the exchange line, condensed in a product evaporator 23 and then sent to the medium-pressure column 11.

The low-pressure column 13 comprises a vessel evaporator and an intermediate evaporator 17. The intermediate evaporator 17 is heated by means of a fraction 33 of a nitrogen flow 31 drawn off from the medium-pressure column at the pressure of the top of the medium-pressure column.

Another fraction 37 of the medium-pressure nitrogen is compressed in a compressor 61 having a cryogenic inlet temperature. The fraction is cooled at the outlet of this cold compressor 61 by direct contact with a cryogenic liquid 45, in order to be brought to its dew point, before being condensed. The cryogenic liquid 45 preferentially comprises a portion of the fluid which has just been condensed in the vessel evaporator 15. The cryogenic liquid comprises at least 70 mol % of nitrogen, indeed even at least 90 mol % of nitrogen. Thus, a pipe brings, to the outlet of the cold compressor, a portion of the nitrogen condensed in the vessel evaporator.

The operation in which the gas and the liquid 45 are brought into contact can be carried out directly in the pipeline or in a specific installation, using injection nozzles, physical contactors, the liquid 45 being compressed either by hydrostatic height or using a pump.

The remainder of the liquid condensed in the vessel evaporator 15 is sent in part to the top of the low-pressure column 13 to form reflux.

An oxygen-enriched liquid 49 and a nitrogen-enriched liquid 53 are sent from the medium-pressure column 11 to the low-pressure column 13.

A flow of liquid oxygen 19 is withdrawn from the vessel of the low-pressure column, pressurized up to a low pressure of 1.5 to 4 bar by a pump 21 and then evaporated in an evaporator 23 by an exchange of heat with the air. A non-evaporated portion of the oxygen is withdrawn as bleed 25.

The vessel evaporator 15 is preferably a falling-film evaporator.

A portion 39 of the medium-pressure nitrogen is reheated in the exchange line 9, is reduced in pressure in a turbine 41 and is then again reheated in the exchange line 9.

The invention applies to any gas compressed in a cold compressor, which has to condense in an evaporator where there is a risk of evaporation to dryness with regard to oxygen in the presence of an impurity of $C_nH_m$ type.

In the example, the cryogenic liquid added upstream of the cold compressor comes from the system of columns but the liquid can originate from an external source and can, for example, be taken from a storage tank for feed liquid or for liquid stored in a weighing system.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced on the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value, When such a range is expressed, it is to be understood that another embodiment is from the one particular value and/or to the other particular value, along with all combinations within said range.

What is claimed is:

1. A process for the separation of air in a system of columns by cryogenic distillation in which compressed air, purified and cooled, is separated in the system of columns in order to form an oxygen-enriched flow and a nitrogen-enriched flow, in which at least one column of the system of columns comprises an evaporator/condenser which has to ensure the evaporation of a liquid enriched in oxygen with respect to the air by means of an exchange of heat with a calorigenic fluid, the calorigenic fluid having been compressed upstream of the evaporator/condenser in a compressor having a cryogenic inlet temperature, the calorigenic fluid being at least partially condensed in the evaporator/condenser, wherein a cryogenic liquid is added to the calorigenic fluid upstream of the evaporator/condenser, wherein the cryogenic liquid is added to the calorigenic fluid downstream of the compressor.

2. The process as claimed in claim 1, wherein the cryogenic liquid is composed of a portion of the calorigenic fluid after the calorigenic fluid has been condensed in the evaporator/condenser.

3. The process as claimed in claim 1, wherein the system of columns comprises a double or triple column, the calorigenic fluid is a nitrogen-enriched stream withdrawn from a column operating at higher pressure of the double or triple column, and the evaporator/condenser is in a different column of the double or triple column operating at lower pressure.

4. The process as claimed in claim 1, wherein the evaporator/condenser is a falling-film evaporator.

5. The process as claimed in claim 1, wherein the cryogenic liquid is pressurized either by hydrostatic pressure or by a pump.

6. The process as claimed in claim 1, wherein the cryogenic liquid comprises at least 75 mol % of nitrogen.

7. The process as claimed in claim 1, wherein the cryogenic liquid comprises at least 90 mol % of nitrogen.

8. A device for the separation of air in a system of columns by cryogenic distillation, comprising:

a) system of columns comprised of a low-pressure column and a medium-pressure column;

b) an evaporator/condenser configured to evaporate a liquid enriched in oxygen with respect to the air, the evaporator/condenser having an inlet and an outlet;

c) an air compressor in fluid communication with the system of columns;

d) a cryogenic compressor configured to compress a cryogenic fluid, the cryogenic compressor being in fluid connection with the inlet of the evaporator/condenser; and e) a means for pressurizing a cryogenic liquid disposed in a pipe connecting the outlet of the evaporator/condenser with the outlet of the cryogenic compressor, wherein the evaporator/condenser is in fluid communication with at least one column of the system f columns, wherein the outlet of the evaporator/condenser and/or a storage tank for cryogenic liquid is fluidly connected to an outlet of the cryogenic compressor without passing through the evaporator/condenser.

9. The device as claimed in claim 8, wherein the system of columns comprises a double or triple column, and wherein the evaporator/condenser is configured to act as a vessel evaporator.

10. The device as claimed in claim 8, wherein the inlet of the cryogenic compressor is connected to the top of the medium-pressure column.

11. The device as claimed in claim 8, further comprising a pipe connecting the outlet of the evaporator/condenser to the outlet of the cryogenic compressor without passing through the evaporator/condenser.

12. An oxy-combustion plant, comprising the air separation device as claimed in claim 8, and a boiler fed with oxygen produced by the air separation device.

13. A device for the separation of air in a system of columns by cryogenic distillation, comprising;

a) a system of columns comprised of a low-pressure column and a medium-pressure column;

b) an evaporator/condenser configured to evaporate a liquid enriched in oxygen with respect to the air, the evaporator/condenser having an inlet and an outlet;

c) an air compressor in a fluid communication with the system of columns;

d) a cryogenic compressor of calorigenic in fluid connection with the inlet of the evaporator/condenser; and e) a storage tank in fluid communication with a point downstream of the cryogenic compressor and upstream the inlet of the evaporator/condenser, wherein the evaporator/condenser is in fluid communication with at least one column of the system of columns, wherein the outlet of the evaporator/condenser and/or the storage tank for cryogenic liquid is fluidly connected to an outlet of the cryogenic compressor without passing through the evaporated/condenser.

* * * * *